US005181074A

United States Patent [19]

Nemoto et al.

[11] Patent Number: 5,181,074

[45] Date of Patent: Jan. 19, 1993

[54] TONER REPLENISHING DEVICE

[75] Inventors: Mitsugu Nemoto; Noboru Koizumi; Shigeru Okazaki, all of Hachioji, Japan

[73] Assignee: Konica Corporation, Tokyo, Japan

[21] Appl. No.: 671,173

[22] Filed: Mar. 15, 1991

Related U.S. Application Data

[63] Continuation of Ser. No. 465,469, Jan. 16, 1990, abandoned.

[30] Foreign Application Priority Data

Jan. 20, 1989 [JP] Japan ..... 1-11095
Jan. 20, 1989 [JP] Japan ..... 1-11096
Jan. 20, 1989 [JP] Japan ..... 1-11100

[51] Int. Cl.[5] ..... G03G 15/06

[52] U.S. Cl. ..... 355/245; 118/653; 118/657; 222/DIG. 1; 355/246

[58] Field of Search ..... 355/245, 246, 251, 253, 355/259; 222/DIG. 1; 118/653, 657, 658

[56] References Cited

U.S. PATENT DOCUMENTS

| | | | |
|---|---|---|---|
| 3,941,084 | 3/1976 | Kurita | 118/657 |
| 4,003,335 | 1/1977 | Kurita et al. | 118/658 |
| 4,193,376 | 3/1980 | Hamaguchi et al. | 118/657 X |
| 4,293,085 | 10/1981 | Nakajima et al. | 355/245 X |
| 4,436,055 | 3/1984 | Yamashita et al. | 118/658 |
| 4,502,412 | 3/1985 | Jones | 118/658 |
| 4,705,383 | 11/1987 | Hiraga et al. | 355/253 |
| 4,844,008 | 7/1989 | Sakemi et al. | 355/253 X |

FOREIGN PATENT DOCUMENTS

| | | | |
|---|---|---|---|
| 3840712 | 6/1989 | Fed. Rep. of Germany . | |
| 0086225 | 7/1978 | Japan | 118/657 |
| 0052168 | 3/1988 | Japan | 355/253 |

OTHER PUBLICATIONS

Patent Abstracts of Japan, vol. 6, No. 30, (P-103)(908); Feb. 23, 1982, JPA-56-150,768; Nov. 21, 1981.

Patent Abstracts of Japan, vol. 11, No. 178 (P-584)(2625) Jun. 9, 1987, JPA-62-7073; Jan. 14, 1987.

*Primary Examiner*—A. T. Grimley
*Assistant Examiner*—Christopher Horgan
*Attorney, Agent, or Firm*—Jordan B. Bierman

[57] ABSTRACT

The invention provides a developing apparatus in which toner is mixed with magnetic carrier particles by agitator in an agitating part so as to form two component type developer. The device for feeding toner has a rotatable feeding roller disposed above the agitating part of said developing apparatus for feeding toner thereto, the feeding roller including plural magnets therein so that magnetic carrier particles are attracted to form magnetic brush around the circumference of the feeding roller and toner is conveyed by the magnetic brush with the rotation of the feeding roller. Between the agitating part and the feeding roller, there is provided a partition having an opening positioned beneath the feeding roller so that the magnetic brush passes across the opening and the conveyed toner drops into the agitating part through the opening. At one side of the periphery of the opening, there is provided a prevention plate for preventing toner leakage, and at another side of the periphery of the opening opposite to the one side, there is provided a regulating plate for regulating a height of said magnetic brush.

20 Claims, 6 Drawing Sheets

TONER REPLENISHING DEVICE

This application is a continuation of application Ser. No. 07/465,469, filed Jan. 16, 1990, now abandoned.

BACKGROUND OF THE INVENTION

The present invention relates to a toner replenishing device of an electrophotographic copying machine.

In a toner replenishing device of a popular type for a copying machine wherein two-component developers are used, a toner replenishing room located over a developer agitating chamber in the toner replenishing device is provided, at its opening, with a toner replenishing roller whose rotation causes toners to fall into the toner agitating chamber.

Following replenishing methods have so far been known as a conventional toner replenishing method.

(1) A toner replenishing method wherein a toner replenishing roller is provided with gauge grooves arranged on the surface of the roller in parallel with the roller axis, and excessive toners sticking to the roller surface are scraped off by a gauging blade arranged to be in a sliding contact to the roller surface, thus toner in a constant amount is replenished for each replenishment. (Japanese Patent Publication Open to Public Inspection No. 6872/1982 (hereinafter referred to as Japanese Patent O.P.I. Publication)).

(2) A toner replenishing method wherein a replenishing roller is provided thereon with spiral grooves and a scraper that is in a sliding contact with the roller surface scrapes off excessive toners, thus toner is replenished (Japanese Patent O.P.I Publication No. 56948/1975).

(3) A toner replenishing method wherein toner is fed out of a toner replenishing room by elastic fine bristles (metallic or nylon brush or the like) flocked on the surface of a toner replenishing roller and then are scraped off by a scraper (Japanese Patent O.P.I. Publication No. 60933/1979).

However, aforesaid conventional replenishing devices have had a problem that toner replenished into a developer agitating chamber cannot be mixed uniformly with carrier in the developer agitating chamber.

Namely, in the aforesaid methods (1), (2), and (3), scraped toners fall in a form of a clod and the clod stays in the agitating chamber, thus toners sometimes cannot be mixed uniformly with carrier.

An effective method to avoid such phenomenon is represented by the method (Japanese Patent O.P.I. Publication No. 7073/1987) wherein an opening of a toner replenishing room is so arranged as to contact with the developer in a developer agitating chamber and toner is conveyed by a carrier brush formed round a toner replenishing roller provided at the opening. In a small-sized copying machine, however, this method cannot be employed because of the restriction in terms of design; in many cases, the toner replenishing room has to be provided over the developer agitating chamber.

SUMMARY OF THE INVENTION

In view of the aforesaid points, an object of the present invention is to offer a toner replenishing device wherein it is possible to replenish toners from a toner replenishing room provided over a developer agitating chamber, while mixing the toner with carrier in advance.

In order to attain the aforesaid object, a toner replenishing device of the invention is represented by the device wherein a toner replenishing roller whose circumference is provided with S-poles and N-poles magnetized thereon one after the other is provided at the lower opening of the toner replenishing room that replenishes toners into a two-component developer agitating chamber, a toner-spill-prevention member is provided on the toner outlet side at the aforesaid opening and a carrier brush height regulating member is provided on the side opposite to the aforesaid toner outlet side, thereby toners can be replenished while toner is conveyed by the carrier brush and toner and carrier are mixed in advance.

DETAILED DESCRIPTION OF THE INVENTION

The invention will be explained as follows, referring to an example shown in attached drawings.

Figure 1:
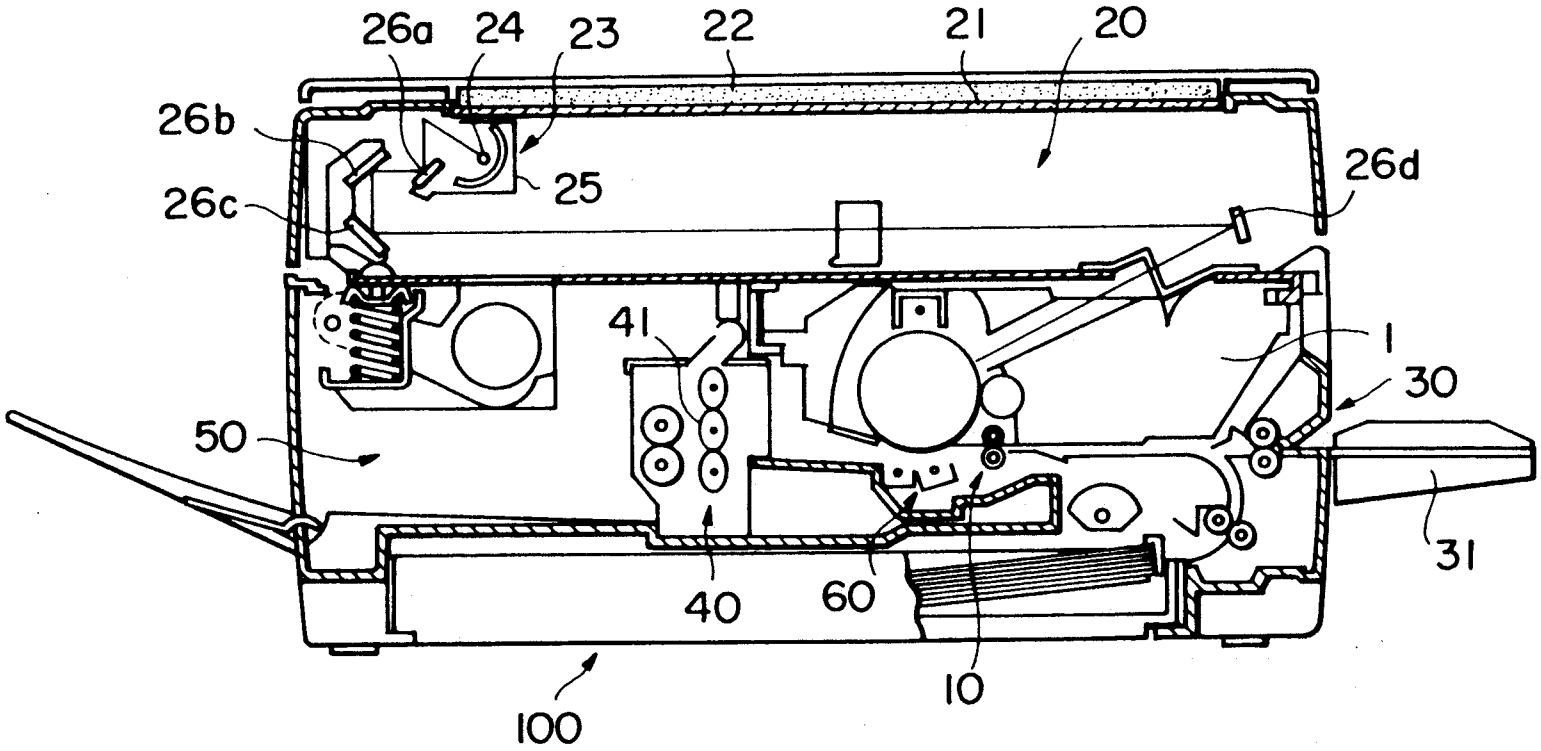
FIG. 1 shows an overall structural view of a copying machine wherein a toner replenishing device of the invention is incorporated.
Figure 2:
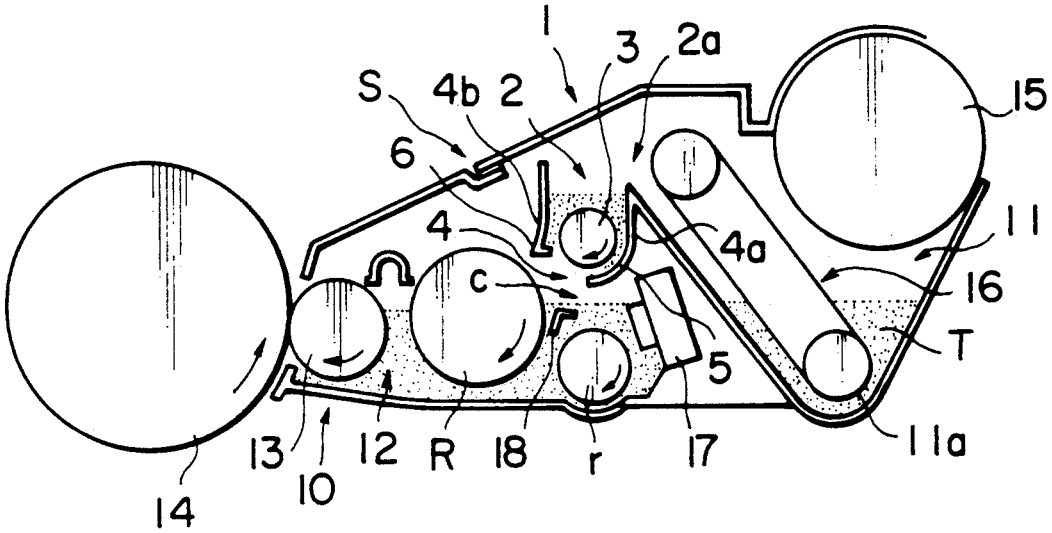
FIG. 2 is a sectional view of the device of the invention.
Figure 3:
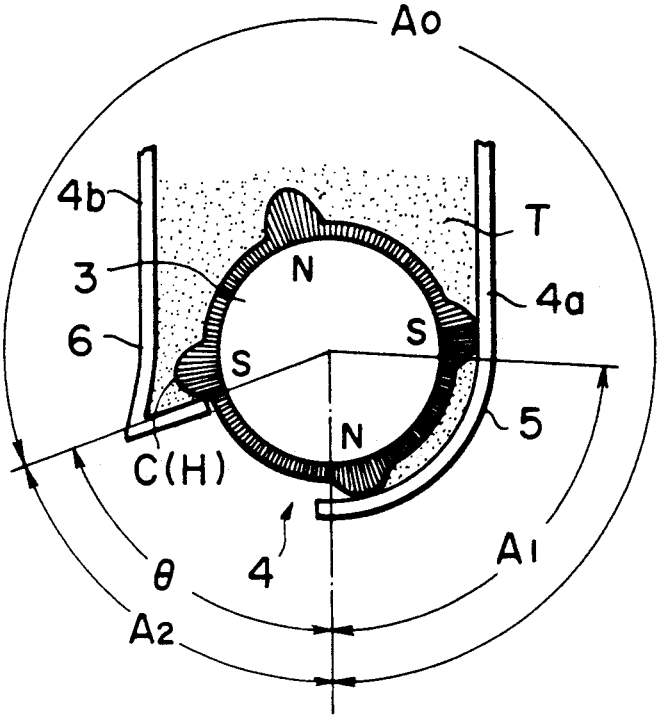
FIG. 3 is an illustration of principle showing an example wherein a toner-spill-prevention member is made of a gutter-formed member.
Figure 4:
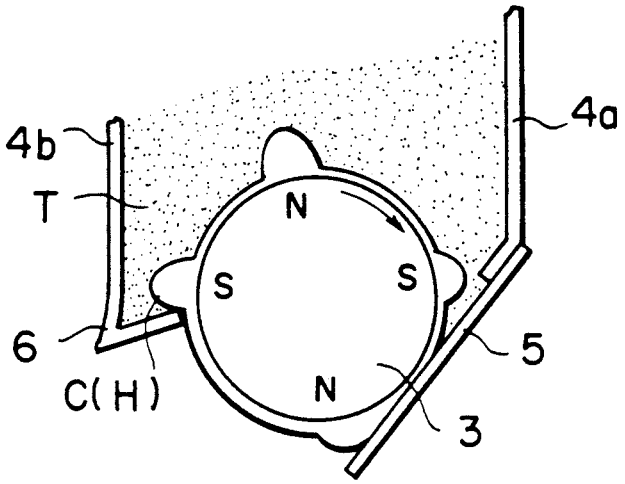
FIG. 4 is an illustration of principle showing an example wherein a toner-spill-prevention member is made of a flexible film and each of FIGS. 5 (*a*), (*b*) and (*c*) is an illustration showing how toner is conveyed by carrier brushes.
Figure 5A:
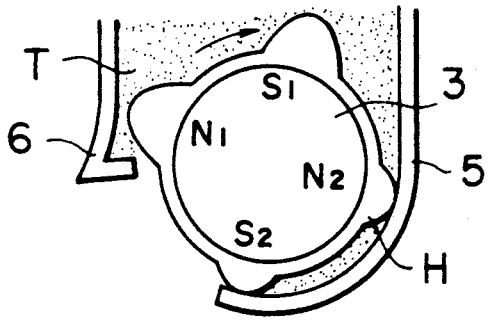
Figure 5B:
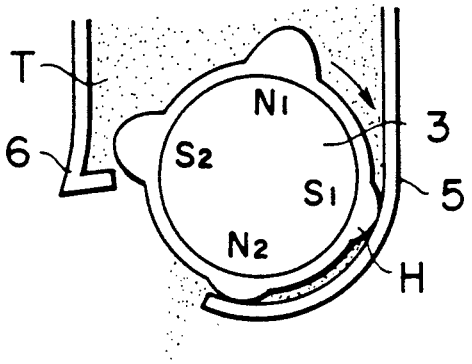
Figure 5C:
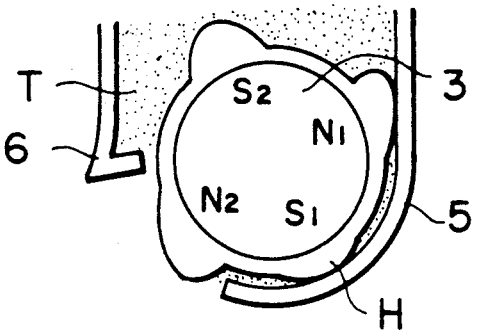

FIG. 1 shows an overall structural view of a copying machine wherein a toner replenishing device of the invention is incorporated, FIG. 2 is a sectional view of the toner replenishing device of the invention, FIG. 3 is an illustration of principle showing an example wherein a toner-spill-prevention member is made of a gutter-formed member, FIG. 4 is an illustration of principle showing an example wherein a toner-spill-prevention member is made of a flexible film and each of FIGS. 5 (*a*), (*b*) and (*c*) is an illustration showing how toner is conveyed by carrier brushes.

In the figure, the numeral 1 is a main body of a toner replenishing device of the invention, and the main body 1 is incorporated in copying machine 100 together with main supplying chamber 11 provided adjacently. The copying machine 100 is provided thereon with exposure unit 20 and is provided therein with developing unit 10, paper-feeding unit 30, fixing unit 40, paper-ejecting section 50 and transfer/separation unit 60.

The exposure unit 20 is provided thereon with platen glass 21 on which a document to be copied is placed, document-holding plate 22 that covers the glass 21, and further with light source-moving optical system 23 that illuminates a document surface on the glass 21 while traveling under the glass 21. The numeral 24 is a light source lamp provided on moving carriage 25, and 26*a*; 26*b*, 26*c* and 26*d* are reflecting mirrors. The light emitted from the light source lamp 24 is reflected on the surface of a document placed on platen glass 21 and then is projected on photoreceptor drum 14 that will be stated later, through reflecting mirrors 26*a*, 26*b*, 26*c* and 26*d*. The aforesaid paper-feeding unit 30 is for feeding image-transfer papers loaded on paper-tray 31.

Developing unit 10 is arranged at the lower part of the aforesaid main body 1 and is composed of developer agitating chamber 12 and developer roller 13 that is adjacent to the agitating chamber 12. Inside the aforesaid main supplying chamber 11, there are provided toner cartridge 15, that is detachable, and toner conveying member 16, thus toner T ejected from the aforesaid toner cartridge 15 can be stored in the bottom portion 11*a* of the main supplying chamber 11. Toner T can be supplied at any time to the adjacent replenishing room 2 of main body 1 through the aforesaid toner conveying member 16 that rotates to move toners T upward obliquely.

The aforesaid main body 1 is provided with toner replenishing room 2 and toner replenishing roller 3 as primary structural factors, and the toner replenishing room 2 is provided at its upper portion with toner-inlet 2*a* for the toner T fed from the aforesaid main supplying chamber 11 and is provided at its lower side with the opening 4 for toner replenishing. The toner replenishing room 2 is further provided with the aforesaid toner replenishing roller 3 at the aforesaid opening 4 located at the lower side of the replenishing room, thus the toner replenishing room can receive, being linked with the upper end portion of the aforesaid toner conveying member 16, the toner T through toner inlet 2*a*. On the side wall 4*a* at the toner outlet side on the aforesaid opening 4, there is provided toner-spill-prevention member 5; and on the wall side opposite to the aforesaid wall side 4*a*, there is provided carrier brush height regulating member 6. The aforesaid tone replenishing roller 3 is provided with S-poles and N-poles magnetized one after the other along its outer circumference, and the magnetic poles enable magnetic carriers C (iron powder or the like) to be attracted magnetically thereto and thereby to form a brush H of carrier C on the aforesaid outer circumference. The number of poles to be magnetized on the aforesaid roller 3 may be any of 2, 4, 6 and 8, and in the example wherein the number of poles is 4, there is formed locally the brush H (FIG. 5 (*a*)) at the magnetizing portion, and when the roller 3 rotates, the brush H sweeps the inside of the toner replenishing room 2 and takes toner T in the brush H to convey them to the lower opening 4 (FIGS. 5 (*b*) and (*c*)).

Aforesaid toner-spill-prevention member 5 is for preventing, by means of carrier brush H, the toners T from dropping through the clearance between the side wall 4*a* at toner outlet side on the opening 4 and toner replenishing roller 3, and it is made of a gutter-formed member having a J-formed sectional view and protrudes from the aforesaid side wall 4*a*, maintaining the constant distance from the lower surface of the roller 3. Namely, the gap (the distance between the lower surface of the roller 3 and the member 5) of toner conveying area $A_1$, where the aforesaid toner-spill-prevention member 5 covers the lower surface of roller 3, is smaller than the height of carrier brush H. Therefore, the brush H in the toner conveying area $A_1$ functions as a stopper that prevents toner T from flowing down (FIG. 3). The lower end portion of toner-spill-prevention member 5 is almost horizontal and it receives the toner which have passed through the brush H and the toner which have left the toner replenishing roller 3, thus preventing the toner dropping. The aforesaid toner-spill-prevention member 5 may either be formed to be of a one body with aforesaid side wall 4*a* at toner outlet side, or be a separate member to be attached.

Incidentally, toner-spill-prevention member 5 may further be a flexible film protruding from the side wall 4*a* at toner outlet side on opening 4 and contacting lightly the lower surface of the roller 3 as shown in FIG. 4.

Aforesaid carrier brush height regulating member 6 is for regulating the height of carrier brush entering the toner contact area $A_0$ (lower portion of toner replenishing room including toner conveying area $A_1$ ) and is made of a shelf-formed member that extends toward roller 3 from side wall 4 facing the toner-spill-prevention member 5 on the aforesaid opening 4. The edge of the regulating member 6 touches, in the opening area $A_2$ spanning from the lower edge of the toner-spill-prevention member 5 to the regulating member 6, the tip of the brush H formed on the roller 3 when carriers are additionally attracted magnetically from the side of developer agitating chamber 12, thus it is possible to regulate the tip of the brush. The gap between the regulating member 6 and roller 3 is determined by a number of factors such as the magnetic adsorption intensity of roller 3 and the particle size of carrier C; however, it is usually preferable that the gap is about 70%–90% of the height of brush H.

Incidentally, aforesaid toner replenishing room 2 and main supplying chamber 11 are unified solidly into a unit in one piece and the unit is detachable at joint line S from developing unit 10, which means that the unit can be removed from copying machine 100 on the occasion of maintenance or the like.

Aforesaid developer agitating chamber 12 is provided therein with an auxiliary agitating roller r and a principal agitating roller R. The auxiliary agitating roller r is located on the side of paper feeding section so that it may convey to the principal agitating roller R the developer comprising toner T supplied from toner supplying room 2 and carrier C both supplementally-mixed. The principal agitating roller R is located adjacently to the aforesaid developing roller 13 and it further mixes thereunder the developer supplied from auxiliary agitating roller r and supplies the developer to developing roller 13, and concurrently agitates thereon the developer which has become carrier-rich after discharging its toner T toward the vicinity of the opening area $A_2$ for the aforesaid replenishing roller 3, thus supplementing the formation of a brush.

The numeral 17 is a detection sensor for the toner concentration and it is located at the proper position in the vicinity of auxiliary agitating roller r so that it may detect the toner concentration based on the change in inductance of developer running in the neighborhood of auxiliary agitating roller r. It is arranged so that the toner concentration can be detected based on the change of the magnetic permeability of a developer. The numeral 18 is a flow-quantity-regulating plate and it is for dividing the flow in developer agitating chamber 12 into the lower flow layer (the layer between auxiliary agitating roller r and the bottom side of principal agitating roller R) and the upper flow layer (the layer between the upper side of principal agitating roller R and the portion directly under toner replenishing room 2). The flow-regulating plate is made of an L-shaped member provided mostly at the center between roller r and roller R.

Aforesaid photoreceptor drum 14 is arranged so that it can rotate, being linked with and contacting to the aforesaid developing roller 13, thus an electrostatic latent image is formed on the photoreceptor drum by the light from aforesaid exposure section 20, and toner T from developing roller 13 is adsorbed to the electrostatic latent image to form a toner image; further, the toner image is transferred onto the image-transfer paper.

Toner T dropped from toner cartridge 15, after being stored on the bottom 11*a* of main supplying chamber 11, is transported by toner conveying member 16 and fed into toner replenishing room 2 of main body 1 through inlet 2*a*. When toner replenishing roller 3 of a magnet type rotates, the brush H conveys toner T through toner transport area $A_1$ and feeds it to developer agitating chamber 12 through the lower opening 4. In this case, the height of brush H is regulated suitably by brush height regulating member 6, and toner T not scooped by brush H is supported by toner-spill-prevention member 5. Further, toner T enters the brush H diffusively, resulting in a preliminary mixture of toner T and carrier C, which prevents in advance the generation of small toner lumps.

After toner T and carrier C are mixed uniformly by auxiliary agitating roller r and principal agitating roller R in developer agitating chamber 12, the toner is transferred to photoreceptor drum 14 by developing roller 13.

In the exposure section 20, light emitted from light source 24 located on carriage 25 is reflected on a document placed on platen glass 21, and arrives, through reflection mirrors 26*a*, 26*b*, 26*c* and 26*d*, at photoreceptor drum 14 where there is formed an electrostatic latent image which then adsorbs toner T to form a toner image. The toner image is transferred on an image-transfer paper fed from paper feeding unit 30 at transfer/separation unit 60 and then fixed by the fixing roller of fixing unit 40 onto the image-transfer paper which is then ejected from paper ejecting unit 50.

The present invention enables toner in the toner replenishing room to be conveyed by the carrier brush while the toner and carrier are mixed in advance, because the invention is characterized in that a toner replenishing roller on which N-poles and S-poles are magnetized one after the other along its circumference is provided at the lower opening of a toner replenishing room that replenishes toners into two-component developer agitating chamber, and that a toner-spill-prevention member is provided on the toner outlet side at the aforesaid opening and a carrier brush height regulating member is provided on the side opposite to the aforesaid toner outlet side. Further, the toner failed to be conveyed by the carrier brush in the toner replenishing room is stopped by the toner-spill-prevention member and thereby does not drop into the developer agitating chamber, and adjustment of toner conveyance and preliminary mixing can be made by controlling the height of the brush height regulating member.

As a result, there is no fear that toner clods are produced in the toner agitating chamber despite an arrangement that a toner replenishing room is provided over a developer agitating chamber, thus it is possible to achieve the uniform imaging and stability of developer, which results in an excellent effect of an improvement of quality of a copied image.

A preferable embodiment of a toner replenishing device of a magnet roller type stated above will be explained as follows.

Figure 6:
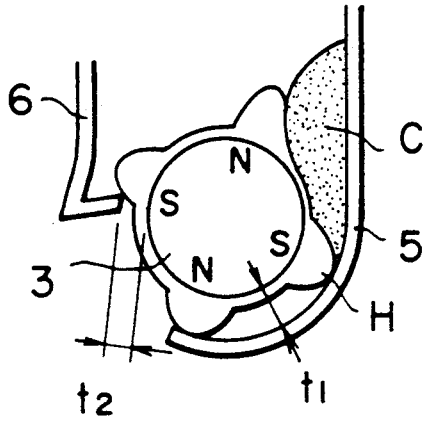
FIG. 6 is an illustration showing how a carrier pool is generated and showing the relation between $t_1$ and $t_2$.
Figure 8:
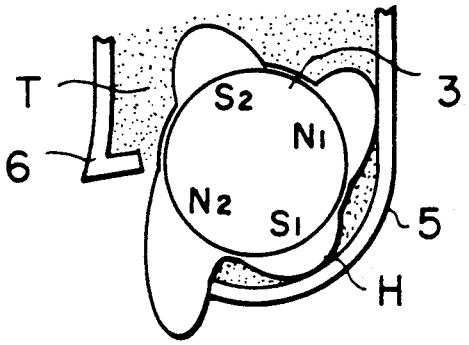
FIG. 8 is an illustration showing the brush hanging down.

In this magnet roller type replenishing device, a carrier brush scrapes the inner surface of a replenishing room to convey toners, and there is a risk, that apart of the carrier brush falls off, when it scrapes and stays in the replenishing room (FIG. 6). When this carrier stays at the toner outlet of the opening and forms a 'carrier clod', it adversely affects the toner flow, causing the fear that the condition close to the idle running of the roller will be generated.

In the light of the aforesaid point, an object of the example is to provide a toner replenishing device which is of a magnet roller type and yet does not cause a risk of the generation of a 'carrier clod'.

In order to achieve the aforesaid object in the toner replenishing device of the invention, a toner replenishing roller whose circumference is furnished with S-poles and N-poles magnetized thereon one after the other is provided at the lower opening of the toner replenishing room that replenishes toners into a two-component developer agitating chamber, a toner-spill-prevention member is provided on the toner outlet side at the aforesaid opening, and a carrier brush height regulating member is provided on the side opposite to the aforesaid toner outlet side; and the distance between the aforesaid brush height regulating member and the replenishing roller is made to be smaller than that between the aforesaid toner-spill-prevention member and the replenishing roller and the height of the carrier brush is controlled so that no carrier may fall off in the toner replenishing chamber.

Namely, as shown in FIG. 6, the distance $t_2$ between the aforesaid regulating member 6 and the roller 3 is arranged against the distance $t_1$ between the aforesaid toner-spill-prevention member 5 and the lower side of the roller so that they satisfy the following relation, $$t_2 < t_1$$

and thereby it may be prevented that the tip of the brush H regulated by the distance $t_2$ hits the side wall 4*a* at toner outlet side or hits the toner-spill-prevention member 5 and thereby carriers come off, resulting in the generation of carrier stay.

An embodiment wherein the device is suspended will be explained as follows. In the magnet roller type replenishing device, a carrier brush scrapes the inner surface of the toner replenishing room for conveying toner, and when the unit composed of the toner replenishing room and the main supplying chamber is removed with the replenishing roller suspended, on the occasion of the replacement of a toner cartridge, and when the brush-forming at the opening area (an area spanning from the edge of the toner-spill-prevention member to the brush height regulating member) is suspended, there is a risk that toners held by the brush may drop and scatter.

In the light of the aforesaid point taken into consideration, an object of the example is to provide a toner replenishing device wherein the carrier brush cannot be located at an area of the opening when the replenishing roller stops running.

In order to achieve the aforesaid object, the toner replenishing device of the example wherein the replenishing roller whose circumference is furnished thereon with N-poles and S-poles magnetized one after the other is provided at the lower opening of the toner replenishing room that replenishes toners into a two-component developer agitating chamber, a toner-spill-prevention member in a gutter form having a curved surface along the lower face of the toner replenishing roller at a constant interval is provided at the toner outlet side of the aforesaid opening and a carrier brush height regulating member is provided on the opposite side, is arranged not to cause the carrier brush to stop in the area of the opening, by the arrangement wherein the central angle $\theta$, of the opening area spanning from the edge of the toner-spill-prevention member to the brush height regulating member, satisfies the following relation with the number of magnetic poles on the aforesaid toner replenishing roller, $$\theta < 360°/p$$

and a roller stopping means that stops the magnetic pole within a toner contact zone other than the aforesaid opening area is provided.

Figure 7A:
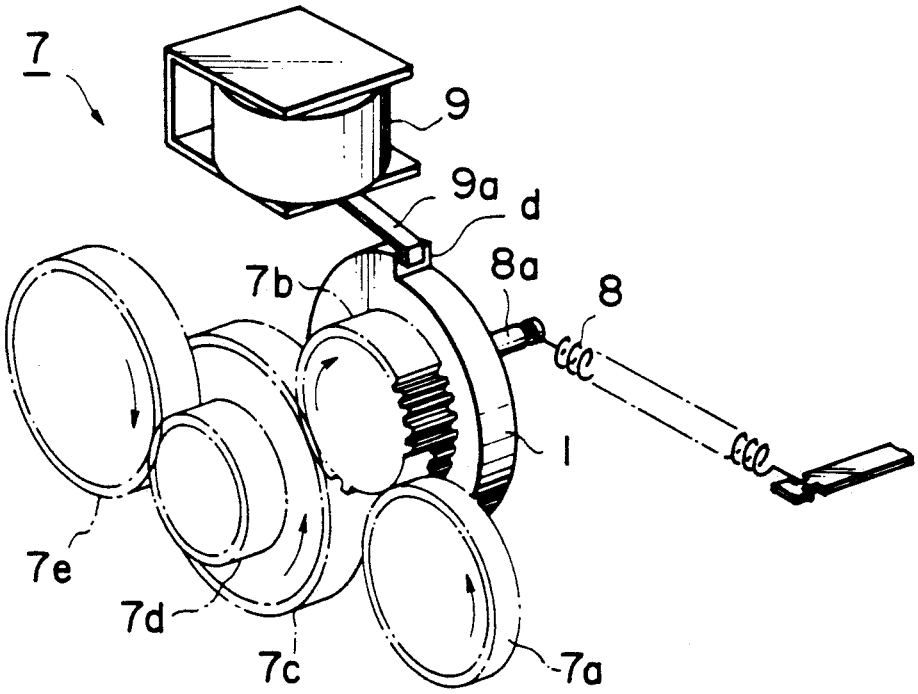
FIG. 7 (*a*) is a perspective view of a roller-stopping means, FIG. 7 (*b*) is a sectional view showing engagement among gear train
Figure 7B:
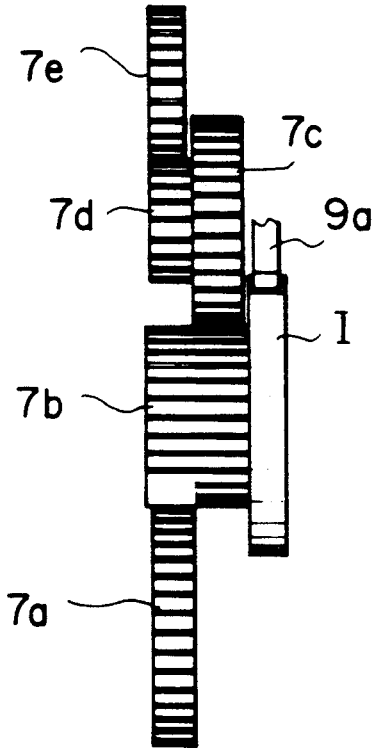

In FIG. 7, the numeral 7 is a roller-stopping means for stopping at the prescribed angular position the brush H formed in the position of a magnetic pole on the aforesaid toner replenishing roller 3 and it comprises driving gear *7a*, partially-toothed gear *7b*, transmission gear *7c*, reduction gear *7d*, replenishing-driving gear *7e*, spring 8, solenoid 9, catch lever *9a* and positioning cam I. A gear train comprising driving gear *7a*, partially-non-toothed gear *7b*, transmission gear *7c*, reduction gear *7d* and replenishing-driving gear *7e* transmits torque in that sequence, and the replenishing-driving gear *7e* rotates toner replenishing roller 3.

The solenoid 9 is switched ON and OFF in response to a signal from control means for controlling the toner density and RUN/STOP of the copy machine, thereby the solenoid regulates transmission of torque with the work of the catch lever *9a*. As shown in FIG. 7 (*b*), the gear surface of the partially-non-toothed gear *7b* consists of a gear portion engaged with the driving gear *7a* and a gear portion engaged with the transmission gear *7c*. For the purpose that the toner replenishing roller 3 rotates by the prescribed angle which corresponds to the number of poles p on the toner replenishing roller, in the gear portion engaged with the driving gear *7a* on the partially-non-toothed gear *7b* there is provided a non-toothed angular area. Aforesaid positioning cam I is for driving and controlling the partially-non-toothed gear *7b* and its radius varies continuously along its entire circumference from the smallest radius to the largest one where it has a step d whose height equals the difference between the smallest radius and the largest one, and it is attached, in a coaxial manner, on the side of partially-non-toothed gear *7b*. By means of solenoid 9, the aforesaid catch lever *9a* catches or releases the step d on the cam I, resulting in the ON/OFF of the torque transmission between driving gear *7a* and partially-non-toothed gear *7b*. The spring 8 controls, through the cam I, each rotation of the partially-non-toothed gear *7b* and its one end is hooked on the fixed portion on copying machine 100 and the other end is hooked on pin *8a* (not coaxial with cam I) provided at a proper position (opposite to partially-toothed gear *7b* side) on the side of the cam I. The spring 8, when the step d is released from the aforesaid catch lever *9a*, energizes the partially-non-toothed gear *7b* to mesh with the driving gear *7a* to transmit the driving torque, thereby the replenishing-driving gear *7e* is rotated. While, when the non-toothed area of partially-non-toothed gear *7b* arrives at the engagement portion of driving gear *7a* after the replenish gear *7e* has rotated by the predetermined angles and torque transmission is thereby suspended, the spring 8 continues energizing the partially-non-toothed gear *7b*. And then, the step d on the cam is caught by the catchlever *9a*, the replenishing-driving gear *7e* is kept at its stop position. Therefore, the ON/OFF operation of solenoid *9a* controls each rotation of partially-non-toothed gear *7b*, thus, the toner replenishing roller 3 that is linked with partially-non-toothed gear *7b* can rotate intermittently by, for example, 90 degrees or 45 degrees.

Incidentally, the roller-stopping means 7 may be a driving system which can control digitally the angular position of toner replenishing roller 3. In this case, the toner replenishing roller 3 may be rotated either in the system wherein it rotates by the angle of 360 degrees/p (number of poles) similarly to the aforesaid partially-non-toothed gear driving system, or in the feedback system wherein an appropriate sensor (a magnetic sensor or a rotary encoder) detects the magnetic pole on the toner replenishing roller 3 and thereby stops it at desired angular position. As stated above, the opening area $A_2$ is determined so that the relation between its central angle $\theta$ and the number of poles on the aforesaid toner replenishing roller 3 may satisfy the inequality below.

$$\theta < 360°/p$$

When stopping the toner replenishing roller 3 by the aforesaid roller-stopping means 7, it is so arranged that the brush H formed at the position of a pole stops other than the opening area $A_2$, but only within toner contact area $A_0$. Therefore, at least one of brushes H surely contacts the toner-spill-prevention member in the toner conveyance area, and thereby functions as a 'stopper' which prevents toner dropping in advance. Further, when step d is released from catch lever *9a* by solenoid 9 in roller-stopping means 7, the spring 8 energizes the partially-non-toothed gear *7b* to rotate and further to mesh with driving gear *7a* for the transmission of torque. The number of teeth of the partially-non-toothed gear *7b* is determined so that it corresponds to the rotating angle of toner replenishing roller 3 that is rotated through reduction gear *7d* and replenishing-driving gear *7e*. Therefore, when the catch lever *9a* catches the step d and thereby the rotation of partially-non-toothed gear *7b* is stopped, the magnetic pole stops surely at the prescribed angular position.

In the roller-stopping means 7, when the number of teeth of each gear is set in the combinations of Example 1 and Example 2 shown in Table 1, the intermittent rotation angles are 90° and 45° respectively. In these cases, it is possible to create the condition wherein no brush H is formed in opening area $A_2$ because the central angle $\theta$ is smaller than 360°/p. Further, it is arranged so that all poles of toner replenishing roller 3 stop within toner contact area $A_0$ which is out of the aforesaid opening area $A_2$.

TABLE 1

Example of arrangement of roller-stopping means

| Symbol | Gear name | Number of teeth (Example 1) | Number of teeth (Example 2) |
|---|---|---|---|
| 7a | Driving gear | 30 | " |
| 7b | Partially-non-toothed gear | (24) | " |
| 7c | Transmission gear | 40 | " |
| 7d | Reduction gear (½) | 20 | " |
| 7e | Replenishing-driving gear | 48 | 96 |

Incidentally, in the toner conveyance area $A_1$, toner T not held by brush H is prevented from dropping by toner-spill-prevention member 5. As stated above, on the aforesaid toner replenishing device in the present example, the relation between the central angle $\theta$, of the opening area spanning from the edge of the aforesaid toner-spill-prevention member to the brush height regulating member, and the number of poles p of the aforesaid toner replenishing roller satisfies the following inequality, $$\theta < 360°/p$$

and the toner replenishing device is characterized in that a roller-stopping means that stops the poles of the aforesaid toner replenishing roller within a toner contact area other than the aforesaid opening area is provided. Therefore, when the roller stops, brushes never be positioned within the opening area.

Therefore, even if the toner replenishing roller is exposed in the case of a cartridge replacement, or of a maintenance, which are performed with carrier brushes conveying toners in a large amount; there hardly is a risk of toner dropping or scattering, resulting in an excellent effect that both toner conveyance efficiency and work efficiency are improved.

What is claimed is:

1. A device for feeding a developer to a developing apparatus, said developer comprising toner particles and carrier particles, said device comprising a replenishing room for receiving said toner particles and said carrier particles, an agitation chamber below said replenishing room and adjacent thereto, said chamber being adapted to receive said toner particles and said carrier particles from said replenishing room, an agitator in said chamber to mix said toner particles and said carrier particles to produce said developer and to convey said developer to a developing device, an opening between said replenishing room and said chamber through which said toner particles and said carrier particles drop into said chamber, said opening having a first edge and a second edge, a feed roller, adjacent to and disposed above said opening, for feeding said toner particles and said carrier particles through said opening, said feed roller including a plurality of magnets therein whereby said carrier particles are attracted to form a magnetic brush, said feed roller being rotatable in a direction such that a point on its periphery passes said first edge and then said second edge, whereby rotation of said feed roller permits said toner particles and said carrier particles to fall through said opening into said chamber, a preventing member surrounding a part of a lower portion of said feed roller, said preventing member being separated from said feed roller by a first clearance having a height less than or equal to that of said magnetic brush, said first clearance being sealed by said magnetic brush when said roller is not rotated whereby said carrier particles are prevented from dropping through a gap between said roller and said preventing member and permitting said toner particles and said carrier particles to drop through said opening as said roller is rotated, and a regulator adjacent said second edge and spaced therefrom by a second clearance, said regulator regulating the height of said magnetic brush.

2. The device of claim 1 wherein said magnets are arranged around the circumference of said feed roller, an open area between said preventing member and said regulator satisfying the relation $$\theta < 360°/P$$

wherein $\theta$ is the arc angle of said area with respect to the center of said feed roller, and P is the number of said magnets.

3. The device of claim 1 wherein said first clearance is larger than said second clearance.

4. The device of claim 1 wherein there is a space between said developer in said chamber and said opening.

5. The device of claim 4 wherein said agitator returns developer which has been used to form a toner image to said space.

6. The device of claim 1 wherein said agitator comprises a rotatable agitation roller.

7. The device of claim 6 wherein said agitation roller has an upper part which is higher than said developer in said chamber.

8. A developing apparatus for an electrophotographic copying machine, said apparatus comprising a developing roller for developing a latent image on an image retainer with a developer containing toner particles and carrier particles;

an agitating device for mixing toner particles and carrier particles therein to produce said developer wherein said agitating device feeds said developer to said developing roller; and a replenisher situated above said agitating means for releasably containing said toner particles, said replenisher having an opening disposed so as to form a space between said developer in said agitating device and said toner particles in said replenisher, a feed roller disposed above said opening, said feed roller including a plurality of magnets therein whereby said carrier particles in said agitating device are attracted to form a magnetic brush thereon, a preventing member surrounding a part of a lower portion of said roller, said preventing member being separated from said feed roller by a first clearance having a height less than or equal to that of said magnetic brush, said first clearance being sealed by said magnetic brush when said roller is not rotated, whereby said carrier particles are prevented from dropping through said opening between said roller and said replenisher and permitting said toner particles and said carrier particles to drop through said opening as said roller is rotated, said feed roller being rotatable in a direction such that a point on its periphery passes said preventing member and then said regulating member.

9. The device of claim 8 wherein said first clearance is larger than said second clearance.

10. The device of claim 8 wherein said agitating device returns developer which has been used to form a toner image to said space.

11. The device of claim 8 wherein said agitating device comprises a rotatable agitation roller.

12. The device of claim 11 wherein said agitation roller has an upper part which is higher than said developer in said chamber.

13. The device of claim 8 wherein said magnets are arranged around the circumference of said feed roller, an open area between said preventing member and said regulating member, said area satisfying the relation $$\theta < 360°/P$$

wherein $\theta$ is the arc angle of said area with respect to the center of said feeding roller, and P is the number of said magnets.

14. The device of claim 8 further comprising a stop means for stopping said feed roller so that none of said magnets is in an open area between said preventing means and said regulating member.

15. A device for feeding a developer to a developing apparatus, said developer comprising toner particles and carrier particles, said device comprising a replenishing room for receiving said toner particles and said carrier particles, an agitation chamber below said replenishing room and adjacent thereto, said chamber adapted to receive said toner particles and said carrier particles from said replenishing room, an agitator in said chamber to mix said toner particles and said carrier particles to produce said developer and to convey said developer to a developing means, an opening between said replenishing room and said chamber through which said toner particles and said carrier particles drop into said chamber, said opening having a first edge and a second edge, a feed roller, adjacent to and disposed above said opening, for feeding said toner particles and said carrier particles through said opening, said feed roller including a plurality of magnets therein whereby said carrier particles are attracted to form a magnetic brush, said feed roller rotatable in a direction such that a point on its periphery passes said first edge and then said second edge, whereby rotation of said feed roller permits said toner particles and said carrier particles to fall through said opening into said chamber, preventing means surrounding a part of a lower portion of said feed roller and separated therefrom by a first clearance, for restraining said toner particles and said carrier particles from dropping through a gap between said roller and said opening and permitting said toner particles and said carrier particles to drop through said opening as said roller is rotated, a regulator adjacent said second edge and spaced therefrom by a second clearance, said regulator regulating the height of said magnetic brush, and a stop means for stopping said feed roller so that none of said magnets is in an open area between said preventing means and said regulator.

16. The device of claim 15 wherein said first clearance is larger than said second clearance.

17. The device of claim 15 wherein there is a space between said developer in said chamber and said opening.

18. The device of claim 17 wherein said agitator returns developer which has been used to form a toner image to said space.

19. The device of claim 15 wherein said agitator comprises a rotatable agitation roller.

20. The device of claim 19 wherein said agitation roller has an upper part which is higher than said developer in said chamber.

* * * * *